United States Patent [19]

Sasaki et al.

[11] 4,386,423

[45] May 31, 1983

[54] ELECTRONIC TIMEPIECE HAVING MULTI-FUNCTIONS

[75] Inventors: Seiko Sasaki; Kazuhiro Asano, both of Tokyo, Japan

[73] Assignee: Kabushiki Kaisha Daini Seikosha, Tokyo, Japan

[21] Appl. No.: 49,477

[22] Filed: Jun. 18, 1979

[30] Foreign Application Priority Data

Jun. 23, 1978 [JP] Japan ..... 53-76008

[51] Int. Cl.[3] ..... G04B 23/02; G04F 5/00

[52] U.S. Cl. ..... 368/73; 368/156

[58] Field of Search ..... 368/10, 12, 72–74, 368/82–84, 155–156, 217–219, 250–251; 364/705, 710, 200, 900

[56] References Cited

U.S. PATENT DOCUMENTS

| | | | |
|---|---|---|---|
| 3,999,059 | 12/1976 | Pitroda | 368/10 X |
| 4,024,386 | 5/1977 | Caudel et al. | 364/200 |
| 4,063,409 | 12/1977 | Bayliss | 368/241 X |
| 4,125,993 | 11/1978 | Emile, Jr. | 340/706 X |
| 4,203,278 | 5/1980 | Kondo et al. | 368/73 |

OTHER PUBLICATIONS

D. L. Cohn et al., "A Step by Step Introduction to 8080 Microprocessor System", Dilithium Press, Forest Grove, Oregon, 1977, pp. 27 and 35.

*Primary Examiner*—Vit W. Miska

*Attorney, Agent, or Firm*—Robert E. Burns; Emmanuel J. Lobato; Bruce L. Adams

[57] ABSTRACT

An electronic timepiece having multi-functions comprises a quartz oscillation circuit as a time standard signal generating circuit, a dividing circuit for dividing the output signal of said quartz oscillation circuit, a timing pulse generating circuit for generating a timing pulse signal which operates many kinds of circuit blocks as an input signal of one part of the output of said dividing circuit, a ROM-circuit as a program memory for executing multi-function operations of the timepiece and others, a program counter and page counter for renewing an address of said ROM-circuit, a RAM-circuit as a data-memory for memorizing a controlling memory, an operated result and a time information, an operation circuit for executing many kinds of operations, a data comparison and a data transformation, a latch circuit as an output data memory circuit for temporarily memorizing a display data or other necessary output data, a driver circuit for displaying all of or a part of the contents of said latch circuit, an alarm sound combining circuit in which a part of the output signal of said dividing circuit can be applied thereto, and wherein at least a part of the address of said program memory is synchronously driven by a 100 HZ signal.

4 Claims, 10 Drawing Figures

ELECTRONIC TIMEPIECE HAVING MULTI-FUNCTIONS

BACKGROUND OF THE INVENTION

The present invention relates to an electronic timepiece having multi-functions and particularly relates to a program memory namely an address driving system of ROM.

Recently, according to a development of IC-manufacturing technique, a timepiece system having a ROM-RAM system has appeared on the market. Thereby, one is able to make a timepiece having many kinds of functions by applying the ROM-RAM system to the timepiece, such as a world time timepiece, a stopwatch, a timer timepiece, an alarm timepiece and a calculating timepiece.

In the prior art of Japanese Laid Open Patent Specification No. 85861/77 (which corresponds to U.S. Pat. No. 4,063,409), a timepiece system having multi-functions is disclosed wherein, an address proceeding of a RAM is prosecuted in synchronization to a timepiece address counter or chronograph address counter. Therefore, it basically differs from an address renewal as a program memory, and a circuit construction of this prior art is composed of a RAM and a operational PLA which is operated by the contents of the counter which is operated in synchronization to 1/10 sec. Therefore, the contents of the address counter is changed every 1/10 second whereby a minimum counting unit as a stopwatch only becomes 1/10 second. Namely, in the conventional type, another 1/100 second counter is prepared in IC as another counter which is separate from the normal time counter.

SUMMARY OF THE INVENTION

The present invention aims to eliminate the above noted difficulty and insufficiency, and the object of the present invention is to provide a multi functional electronic timepiece which enables one to count 1/100 second by operating a part of the program memory in synchronization with a 100 Hz signal.

DETAILED DESCRIPTION OF THE INVENTION

Figure 1:
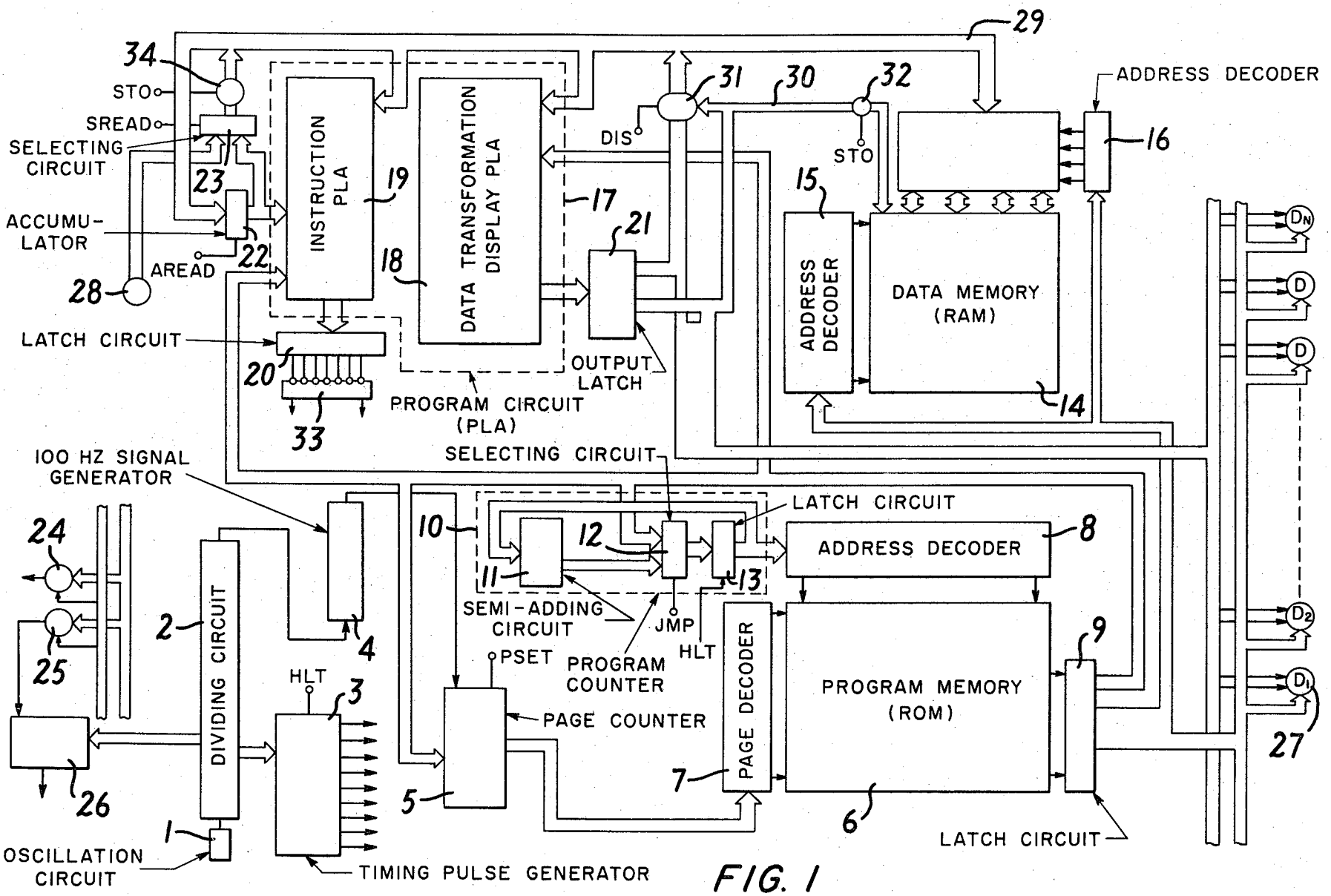
FIG. 1 shows a block diagram of the embodiment of the present invention.

FIG. 1 shows a block diagram in which an output signal of a quartz oscillating circuit 1 which functions as a time standard generating circuit is applied to a dividing circuit 2, a part of the output signal of the dividing circuit 2 is applied to a timing pulse generating circuit 3, an other part of the output signal of the dividing circuit 2 is applied to an alarm sound combining circuit 26. Further, another part of the output signal of the dividing circuit 2 is applied to a 100 Hz generating circuit 4. An output signal of the timing pulse generating circuit 3 generates a signal necessary for a dynamic operation. The 100 Hz signal as the output from the 100 Hz generating circuit 4 is applied to a page counter 5 and is changed to a clock signal. On the other hand, a jump page address signal as a part of the output of ROM output latch circuit 9 receives the output from ROM 6 as a program memory. A page information as an output of the page counter 5 is applied to a page decoder 7. An output of said page decoder 7 becomes a part of ADDRESS of the program memory 6, further an output of a program counter 10 is applied to an address decoder 8, and an output of the address decoder 8 becomes a part of another ADDRESS of the program memory 6. The output of the program memory 6 is applied to the ROM output latch circuit 9, and the output of the latch circuit 9 is applied to the address decoders 15 and 16 of a RAM data memory 14, the output latch circuits 24, 25 and 27, an operation circuit 17, a program counter 10 and the page counter 5.

The program counter 10 is composed of a semi-adding (half adder) circuit 11, a selecting circuit 12 and a ROM-address latch circuit 13 which enables set and reset. An output of the latch circuit 13 is applied to an input of the semi-adding circuit 11, the output of the semi-adding circuit 11 is applied to one input of the selecting circuit 12, a part of the output of the ROM output latch circuit 9 is applied to other input terminal of the selecting circuit 12.

An output of the ROM address latch circuit 13 is applied to the semi-adding circuit 11 and is applied to the address decoder 8. The output signals of the address decoders 15 and 16, a data bus 29 of four bits and processing signal bus 30 of a data memory bit are applied to the data memory 14. The data bus 29 is a bilateral bus, the contents of the data memory 14 are applied to the operation circuit 17 and an accumulator 22.

The operation circuit 17 is composed of a data transforming display PLA 18 and an instruction PLA 19, a part of the output of the data bus 29 and the ROM output latch 9 is applied to the PLA 18, the output of the PLA 18 is applied to a PLA output latch 21. A part of the output of the data bus 29 and the ROM output latch 9 and the output of the accumulator 22 are applied to the instruction PLA 19, the output of the PLA 19 is applied to PLA the output latch circuit 20. The output of the PLA output latch 21 is applied to the gate circuits 31 and 32 and the output latch circuits 24, 25 and 26, the output of the PLA output latch circuit 20 is applied to a gate circuit 33. The outputs of an outer or external switch 28 and accumulator 22 are applied to the selecting circuit 23, the output of the selecting circuit 23 is applied to the data bus 29 through gate circuits 34. Numeral 26 is an alarm sound combining circuit, and a part of output of the output latch 25 and the dividing circuit 2 are applied thereinto, with the output thereof applied to the alarm driving circuit (not shown in the drawings).

Referring now to the operation of the present invention:

The dividing circuit 2 receives a 32,768 Hz signal from the oscillating circuit, and applies the frequency divided signals of 16384 Hz, 8192 Hz and 4096 Hz to the timing pulse generating circuit 3 for generating a timing signal which is necessary to operate the PLA 18 and 19 of the ROM 6, RAM 14 and operation circuit 17. The timing pulse generating circuit 3 generates the timing pulses RAM-INHIBIT, RAMP-PCHG, T11, T12, T21, T22, $\phi 0$, $\phi 1$ and $\phi 2$ of respectively 4096 Hz.

Figure 2:
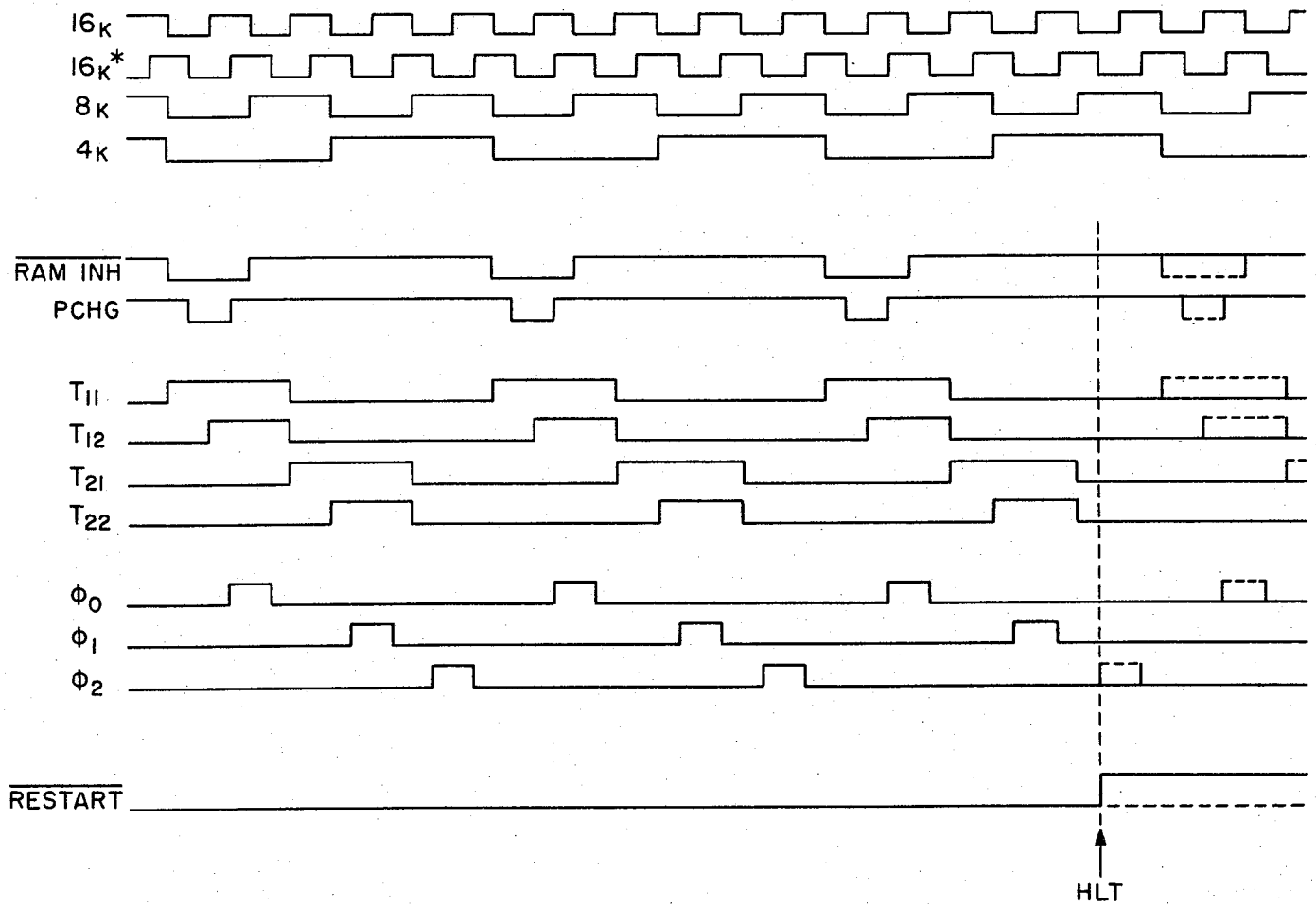
FIG. 2 shows a timing chart of timing pulses used in the present invention.

The RAM-INHIBIT signal is a signal for inhibiting the ADDRESS-assignment of RAM 14 in a certain period, RAM-PCHG is a signal for pre-charging the data-bus 29 in the inhibit period of RAM-ADDRESS-assignment, $T_{11}$ is a signal for pre-charging or evaluating the page decoder 7 and address decoder 8, $T_{12}$ is a signal for pre-charging or evaluating ROM 6, $T_{21}$ is a signal for pre-charging or evaluating AND-array portion of PLA 18 and 19, $T_{22}$ is a signal for pre-charging or evaluating the OR-array portion of said PLA 18 and 19. $\phi_0$ is a timing signal for memorizing a program data which is fed from ROM 6 to ROM output latch 9, $\phi_1$ is a timing signal for memorizing the data which is generated from the PLA 18 and 19 output latches 20 and 21, $\phi_2$ is a timing signal of ROM address latch 13 for memorizing the NEXT ADDRESS of the ROM 6. The above noted relation will be easily understood by seeing the timing-chart in FIG. 2.

The many pulse signals which are generated from the timing pulse generating circuit 3 are applied to ROM 6, PAGE decoder 7, ADDRESS decoder 8, ADDRESS decoders 15 and 16 of RAM 14, PLA 18 and 19, ROM output latch 9, ROM ADDRESS latch 13 and PLA output latches 20 and 21.

Figure 3:
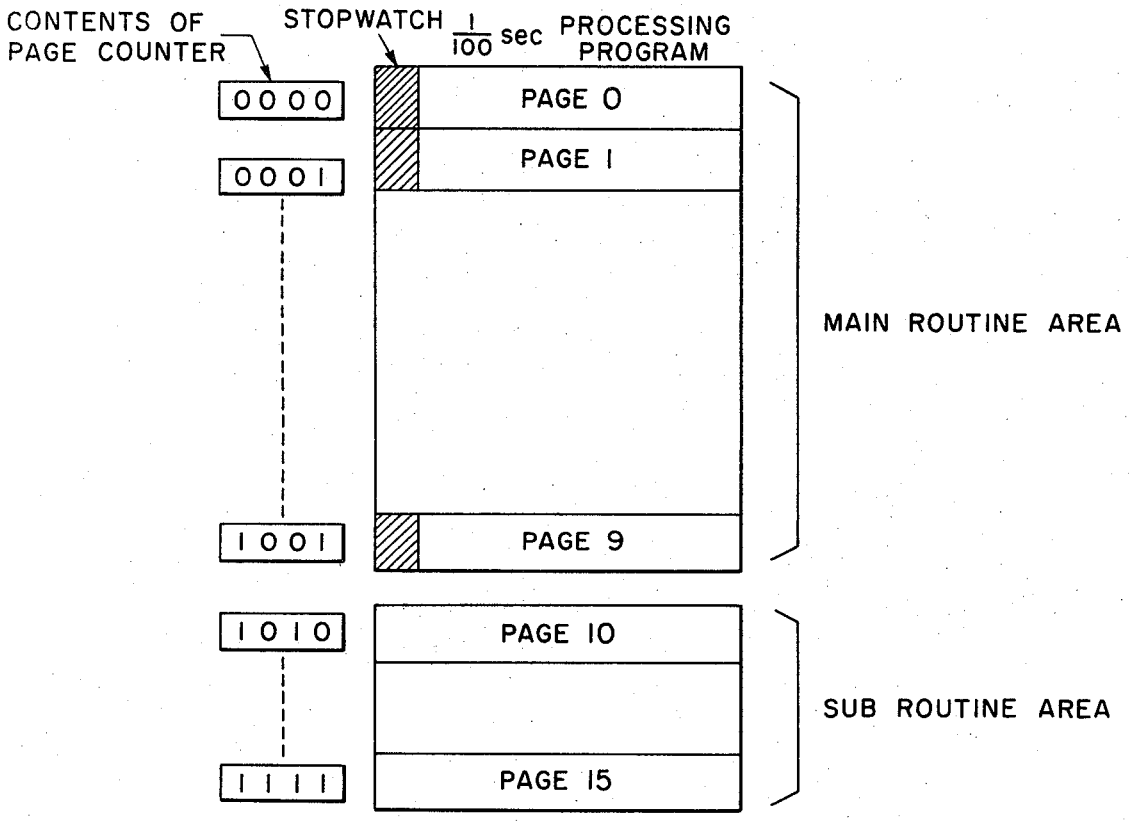
FIG. 3 shows a diagrammatic view for indicating a construction of ROM of a the present invention.

A signal of 4096 HZ output from the dividing circuit 2 is applied to the 100 HZ generating circuit 4, the output of the 100 HZ generating circuit 4 is applied to the page counter 5, whereby it becomes a clock signal. The page counter 5 is a 16-counter of 4 bits which is able to be pre-set and is normally operated as a 10-counter in synchronism with the clock signal, whereby the output thereof counts the pages 0–9 every 0.1 sec period. When the instruction of the PAGE-JUMP is generated as an information from the ROM 6, the data of the ROM output latch 9 is pre-set in the page counter 5. In this case, a preferable information from 0-page to 15-page is pre-set. In the present embodiment, pages 0 to 9 are usually used for a main-routine, and pages 10 to 15 are used as for a sub-routine. A program for counting 1/100 sec of a stop watch is memorized in the top portions of several ADDRESSES, whereby 1/100 sec is counted for every renewal of each page in a stopwatch operation. FIG. 3 shows a construction of the ROM.

Referring now to the operation of the program counter 10:

If a working of ⌜A ADDRESS is executed, a JUMP-ADDRESS ⌜B⌟ of 6 bits which is coded in the ⌜A⌟ ADDRESS is applied to the selecting circuit 12. At this time, if the output of the INSTRUCTION-PLA 19 is the instruction "JUMP", in next time, the selecting circuit 12 does not select the output from the semi-adding circuit 11 of 6-bits and selects the JUMP-ADDRESS B ⌜B⌟ . The JUMP-ADDRESS is memorized in ROM-ADDRESS latch 13 whereby a working of the JUMP-ADDRESS ⌜B⌟ is executed. If a JUMP instruction is not generated from the instruction-PLA 19, the ADDRESS ⌜A⌟ which is executed at present becomes NEXT-ADDRESS by adding ⌜1⌟ according to the semi-adding circuit 11 whereby a content ⌜A+1⌟ is memorized in ROM-ADDRESS latch 13 via selecting circuit 12 whereby a working of ROM ADDRESS ⌜A+1⌟ is executed at the next time. A renewal of each address is executed every 1/4096 sec, i,e, 250 μsec.

The page counter 5 operates as a decade-counter by applying the 100 HZ signal as a clock input whereby it takes about 10 msec to change a content of the counter. Therefore, it is able to execute a maximum a 40-instructions in one page.

According to the above noted description, the ROM 6 changes the outputs of the page counter 5 and program counter 10 as shown in 4→16 and 6→64 decoding and receives the decoded informations of the page decoder 7 and address decoder 8 as the address information whereby each instructions of 19 bits are called out and operate a certain operation.

The information of 19 bits which is generated from the ROM 6 is applied to ROM output latch 9 and is memorized to by the ROM output latch 9 at a timing of $\phi_0$. The data of the ROM output latch 9 is maintained until the next timing pulse signal $\phi_0$ has come. The data of 19 bits is composed of three front parts, a primary part is 7 bits in construction in which an instruction code is memorized, a secondary part is a memorized JUMP ADDRESS or code of output part, further a third part is a memorized ADDRESS of RAM 14. A part of the data of each 19 bits is applied to the program counter 10, another part of the data of each 19 bits is applied to the address decoders 15 and 16 of RAM 14, further another part of the data of each 19 bits is applied to the operation circuit 17 or page counter 5. Additionally another part thereof is applied to the output parts 24, 25 and 27.

The RAM cell of one word four bits is called out by RAM ADDRESS information which is applied to the address decoders 15 and 16 of RAM 14 at a timing of $\phi_0$, the data of RAM 14 is applied to the data transformation of operation circuit 17, display PLA 18, instruction PLA 19 or accumulator 22. Another partial information of 7 bits (instruction code) from the ROM output latch 9 is applied to the operation circuit 17 whereby PLA 18 and 19 which comprises the operation circuit 17 transforms or decodes RAM data into +1 and −1 or display segment data or executes the processing of every bit of RAM data according to the instruction code. The PLA 18 and 19 further execute to compare the accumulator 22 and RAM data and execute to justify a condition with RAM data according to the instruction code and generate the detailed instruction signal. The above noted operations are executed at a timing of $\phi_0$. A plurality of data of the PLA 18 and 19 are impressed to PLA output latches 20 and 21 which memorize each data in a timing $\phi_1$. The information of the PLA output latch is maintained until the next timing $\phi_1$ has come. The information which is memorized in the PLA output latch 20 are the detailed instruction signals which are shown in TABLE-1 as follows:

TABLE 1

| Name of output signal of PLA | Operation |
|---|---|
| S. READ | reading signal of outer switch. |
| A. READ | reading signal for applying data of RAM to accumulator. |
| STO | writing signal for applying data of outer switch and accumulator or operation results to RAM. |
| DIS | displaying signal for displaying data which be decoded display signal |
| P. SET | setting signal for setting a page jump address to page counter. |
| JUM | selecting signal for selecting jump address |

TABLE 1-continued

| Name of output signal of PLA | Operation |
|---|---|
| HLT | stopping signal for stopping a partial operation of system. |

Further a content which is memorized in PLA output latch 21 is an executed result of time operation or decoded information in a display data.

The output data of the PLA output latch 20 and 21 are generated at a timing $\phi_2$ for example through the gates 31, 32 and 33. Namely, the output data i,e, the detailed instruction signals (STO, DIS, JMP, etc. . . . ) of each of PLA output latch 20 are applied to the selecting circuits 12 and 13 or each of the gates 31, 32 and 34, and are applied to the counters, the latch circuits 5, 13 and 22 or the timing circuit 3, whereby a certain circuit operation is ordinarily executed.

Therefore, the detailed operations in the timing $\phi_2$ are executed as follows:

(1) Rewriting of RAM data
(2) Display
(3) Reading the data for accumulator
(4) Reading the information of outer switch
(5) Selecting +1/jump address
(6) Reading page jump address
(7) Executing HLT-instruction (stopping a part of the system which is operated by a dynamic system).

Namely, the execution of working of (5) and (6) are the preparation for executing the next instruction.

According to the above noted description, 1-instruction is executed in 250 μsec, many kinds of time operations are executed by repeating the above noted operations.

Figure 5A:
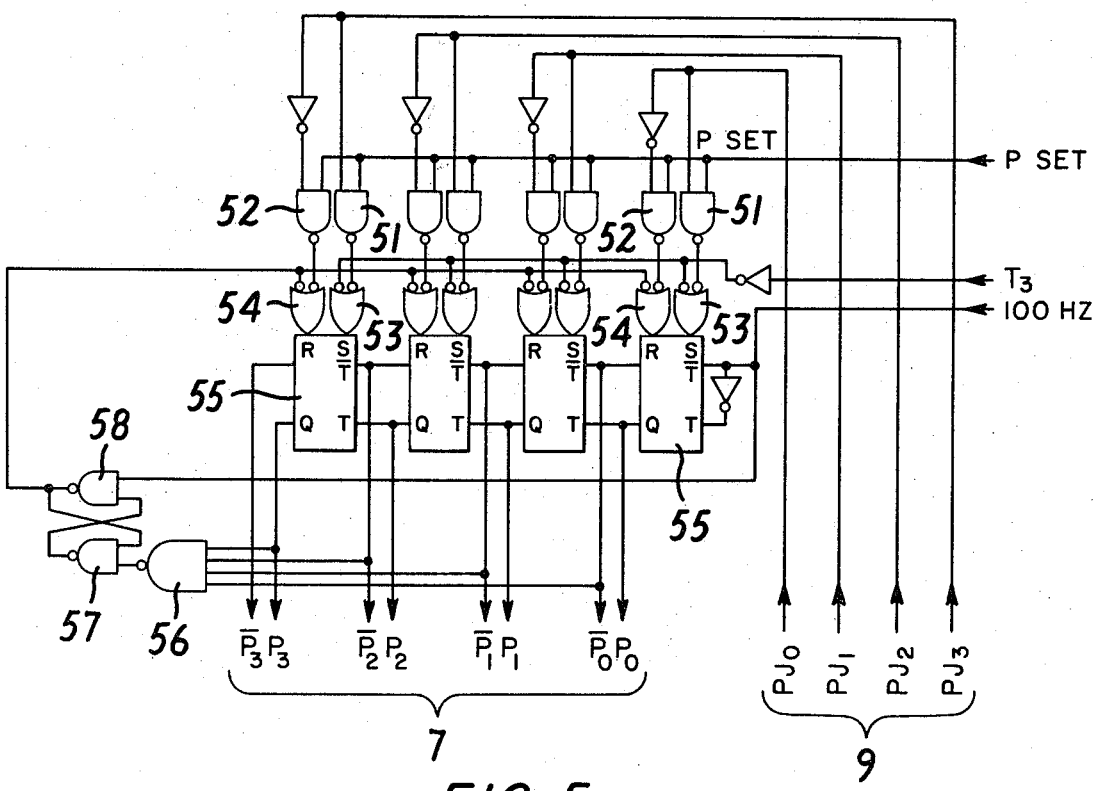
FIG. 5*a* shows a detailed circuit construction.

In order to ordinarily execute a detailed circuit operation, the address of the ROM 6 must be certainly renewed according to a program. The execution of the program is operated by the program counter 10 and page counter 5. The detailed circuit constructions relating to the above noted counters 10 and 5 are shown in FIG. 4 and FIG. 5.

Figure 4A:
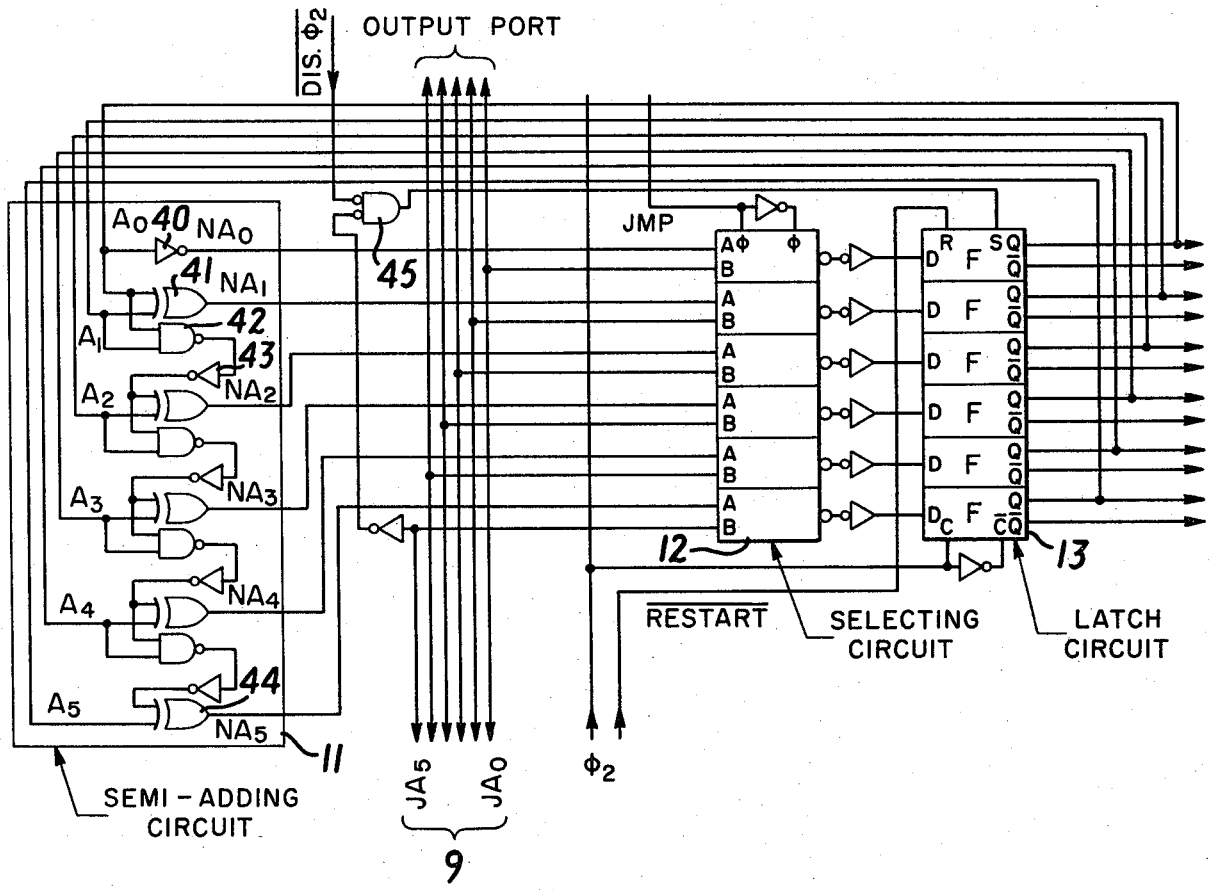
FIG. 4*a* shows a detailed circuit construction of a program counter.
Figure 5B:
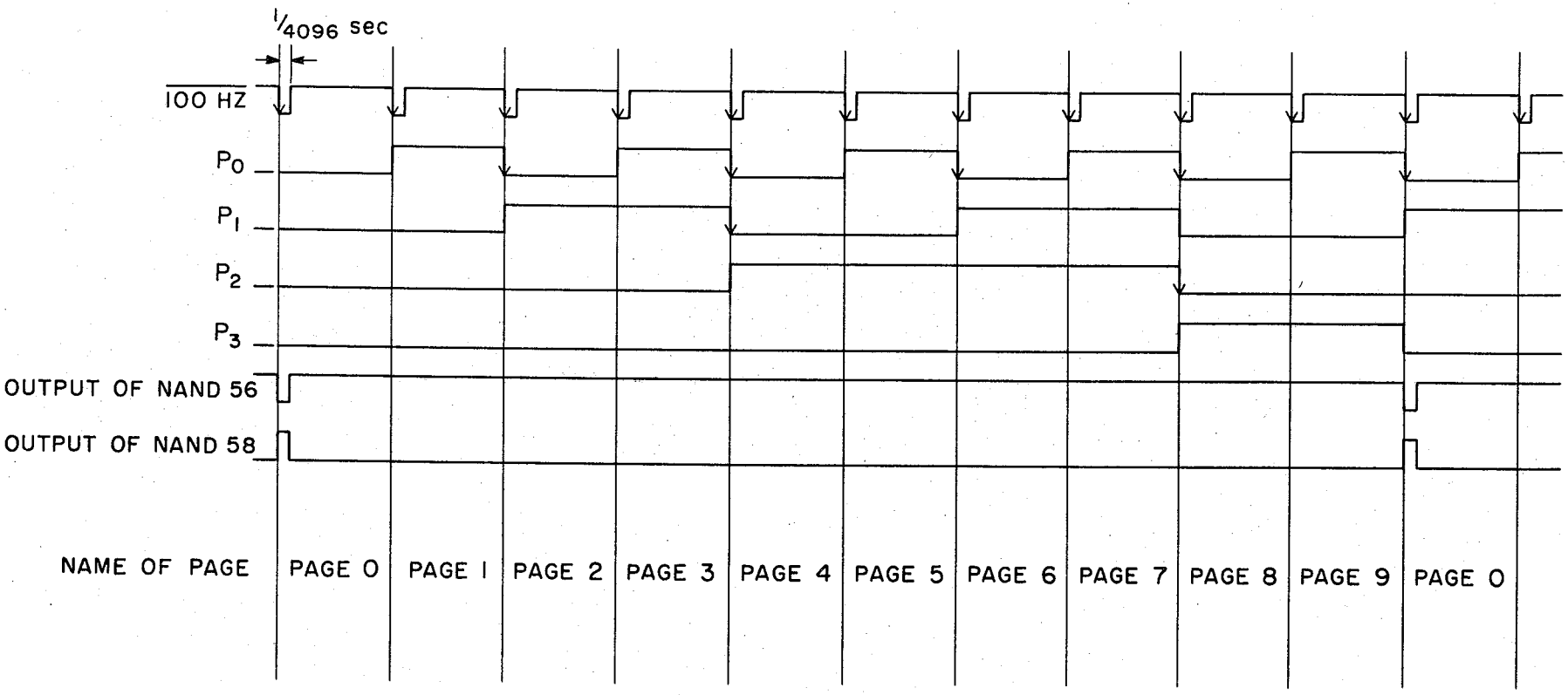
FIG. 5*b* shows an operation of a page counter.

FIG. 4*a* shows a detailed circuit of the semi-adding circuit. A logical formula of the semi-adding circuit is well known, if the inputs are A and B:

$$SUM=\overline{A}\cdot B+A\cdot\overline{B}$$

$$CARRY=A\cdot B$$

The above noted logical formula is displayed as the logical circuit shown hereinafter, as shown in FIG. 4*a*, it is composed of EXCLUSIVE-OR 41, NAND-gate 42 and inverter 43. The semi-adding circuit is composed of 6-bits, it is necessary to prepare six semi-adding circuits, and the added result is necessarily "+1". Therefore the added result becomes "+1" by executing the binary operation, a first bit namely "+1" address of "$A_0$" is "$\overline{A}_0$+NA" (NEXT address of $A_0$) whereby one inverter 40 substantially operates the above noted operation.

Further the seventh bit is not existent whereby it is necessary to provide a carry detection gate, one Exclusive OR 44 substantially operates.

Referring now to the operation thereof, if the instruction at present is a "non display" instruction, NOR-gate 45 generates ⌜0⌟ level since one input terminal DIS. $\phi_2$ is ⌜1⌟ level, a set terminal of the latch 13 is ⌜0⌟ level whereby any of the set functions are not operated. In case of the output [$A_5$ $A_4$ $A_3$ $A_2$ $A_1$ $A_0$] is [001110]=14 ADDRESS, if $A_4$, $A_5$ are second figure as a first 4 bits is 1-figure according to 16-counting signal, whereby becomes [OE] address. (the ADDRESS of PLA or ROM and RAM are displayed by 16-counting system). At the timing of the timing pulse signal $\phi_2$ if the JMP signal is not generated from PLA 19 as a jump instruction, a selection circuit selects an output from the semi-adding circuit 11 whereby the output of the semi-adding circuit 11 is memorized in the latch 13. At this time, $A_0$=0, an output $NA_0$ of an inverter 40 is changed to "1". The other outputs $NA_1$–$NA_5$ are not changed and becomes ADDRESS [001111]=[OE] as a next ADDRESS. The ADDRESS [001111]=[OE] becomes ADDRESS of next ROM and is impressed to ROM-address decoder 8. If a jump-instruction is generated as a result of working in [OE] ADDRESS, a selection terminal JMP of a selection circuit becomes [1] level and selects a JUMP-ADDRESS from ROM-output latch 9, a value thereof is memorized in the latch 13 whereby ADDRESS of next ROM is designated. $\phi_2$ is employed as a clock input of the latch circuit, therefore, a renewal of ADDRESS is executed in synchronism with $\phi_2$.

If an INSTRUCTION being executed is a DISPLAY INSTRUCTION, NOR 45 is opened, however a code of a display output port is memorized by 5-bits in a jump address code of ROM in case of DISPLAY INSTRUCTION, $JA_5$-bit is "0". Therefore, the signal [1] is changed "1" via an inverter, the output of NOR 45 becomes "0" whereby a setting function of the latch 13 is not operated. However in the case of $JA_5$=1, the signal is impressed to an inverter, the output of the NOR 45 becomes "1". In this case, a setting function is actuated, all of output terminals of the latch are changed "1" whereby a next INSTRUCTION becomes [3F].

In case of $JA_5$=0, next ADDRESS is +1 ADDRESS of [$A_5$−$A_0$] which is executed at present. According to the above noted description, in the case of $JA_5$=1, it is jumped to [3F] ADDRESS. In the above noted, [HLT] INSTRUCTION is coded to [3F] ADDRESS, an operation of a portion which is actuated by dynamic operation is stopped.

Figure 4B:
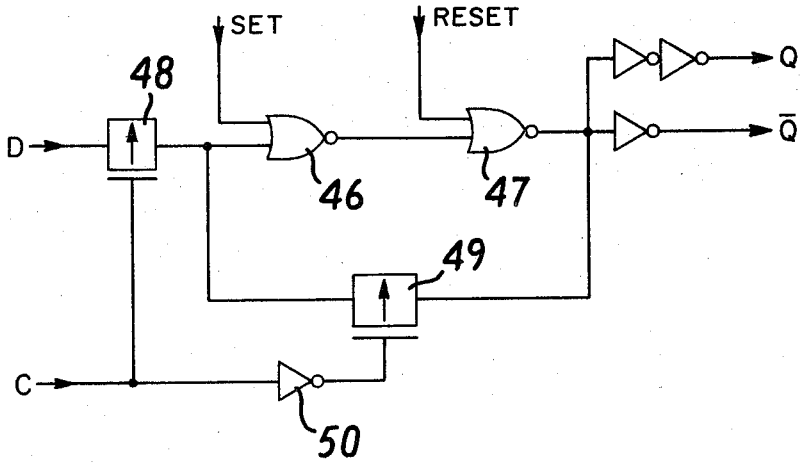
FIG. 4*b* shows a circuit construction of a D-latch having set reset function.

The RESTART terminal is connected to a reset terminal of the latch 13. The RESTART terminal is changed from "1" level to "0" level whenever 100 HZ signal is impressed thereto. The RESTART terminal is at "0" level during the time the system is operated, and a reset function of the latch is not operated. However when [HLT] INSTRUCTION is executed, RESTART terminal is changed from "0" level to "1" level whereby all of output terminals of the latch 13 become "0" level. FIG. 4*b* shows one embodiment of 1-bit of the latch 13. A closed circuit is constructed by NOR 46 and 47 and transmission-gate 48 is connected between a data input terminal D and NOR 46, a clock signal "C" is impressed to a control terminal of the transmission-gates 48 and 49, a clock signal which is inverted by an inverter 50 is impressed to a control terminal of the transmission gate 49. A set signal is impressed to one input terminal of the NOR 46, a reset signal is impressed to one input terminal of the NOR 47. Further an output is obtained from the output terminal of NOR 47 via an inverter. The latch circuit having a set-reset function is not limited to FIG. 4*b*, another design is possible, as one is able to change it to a D-typed FF having reset function.

In FIG. 5, a page counter is constructed by four T-type FF 55 (referred to as TFF hereinafter), the 100 HZ signal is impressed as a clock input. The outputs Q and $\overline{Q}$ of TFF are "$P_0$–$P_3$" as each of page outputs and are "$\overline{P}_6$–$\overline{P}_3$", the output of TFF is impressed to the page decoder 7. The outputs $\overline{P}_0$, $P_1$, $\overline{P}_2$ and $P_3$ of the TFF counter 55 are impressed to input NAND 56 which is a "10" detection gate for detecting a counted contents "10". The output of NAND 56 is connected to one input of NAND 57 which constructs a set reset typed FF together NAND 58, with the 100 HZ signal impressed to one input terminal of NAND 58. The output of the set reset FF is impressed to one terminal of NAND 54, the output of NAND 54 is connected to a reset terminal of TFF. The output of NAND 52 is connected to another input terminal of NAND 54. The output of NAND 53 is impressed to a set terminal of TFF, a test control terminal $T_3$ is impressed to one input terminal of NAND 53, the output terminal of NAND 51 is connected to another input terminal of NAND 53. P-SET terminal as a part of output of the gate 33 is connected to each of one input terminals of NAND 51 and 52. $PJ_0$–$PJ_3$ as PAGE JUMP ADDRESS are impressed to another input terminal of AND 51 according to a grade of page, the signals $\overline{PJ}_0$–$\overline{PJ}_3$ of PAGE JUMP ADDRESS are impressed to another input terminal of NAND 52. The signals $PJ_0$–$PJ_3$ of the PAGE JUMP ADDRESS are obtained from the ROM output latch 9.

Referring now to the operation of the page counter (in this case, we suppose that there is not a page jump signal for easily understanding this operation):

If all of TFF are reset, Q-output of TFF 55, i,e, output level of $P_0$–$P_3$ are "0". In this condition, 100 HZ signal is impressed the T-input terminal of TFF 55 when 100 HZ signal has come, whereby the output "$P_0$" is changed from "0" to "1". At this time, another FF is not changed. Therefore, the set reset type FF which is composed of NAND 57 and 58 is not changed unless the output of NAND 56 is changed whereby the condition at present is maintained. The counting up operation is repeated whenever the 100 HZ signal has come, each of the input terminals of NAND 56 become "1" level when the counting contents becomes "10" whereby the output thereof is changed from "1" to "0". Further the output is changed from "0" to "1" without connection of the contents of another input terminal of NAND 57.

At this time, the 100 HZ signal is applied to one input terminal of NAND 58, the inputs for NAND 58 become "1", the output thereof becomes "0" level, the output of NAND 54 becomes "1" level, TFF 55 becomes a reset condition whereby 10-counting operation is executed.

Referring now to a condition of a page jump:

If PAGE JUMP ADDRESS $PJ_0$, $PJ_1$, $PJ_2$ and $PJ_3$ are generated from ROM output latch, the output "P SET" being read by PLA 19 is generated in synchronism with the timing pulse $\phi_2$, NAND 51 and 52 are opened during this moment whereby JUMP ADDRESS is set to TFF. At this time, the output terminal of the set reset type FF 58 is changed to "1" level whereby NAND 54 is always opened. Further a test signal $T_3$ is not impressed whereby NAND 53 is always opened, further, PAGE JUMP ADDRESS is set to the page counter 5 in any time.

The outputs of NAND 53 become "1" level when the test signal $T_3$ is impressed thereto namely when $T_3$ is changed from 0 to 1 level whereby the outputs of TFF are changed "1", further PAGE ADDRESS designates "15". In the page 15, a test program is memorized, the test program is executed when $T_3$ is impressed whereby the test of the system is executed.

Figure 6A:
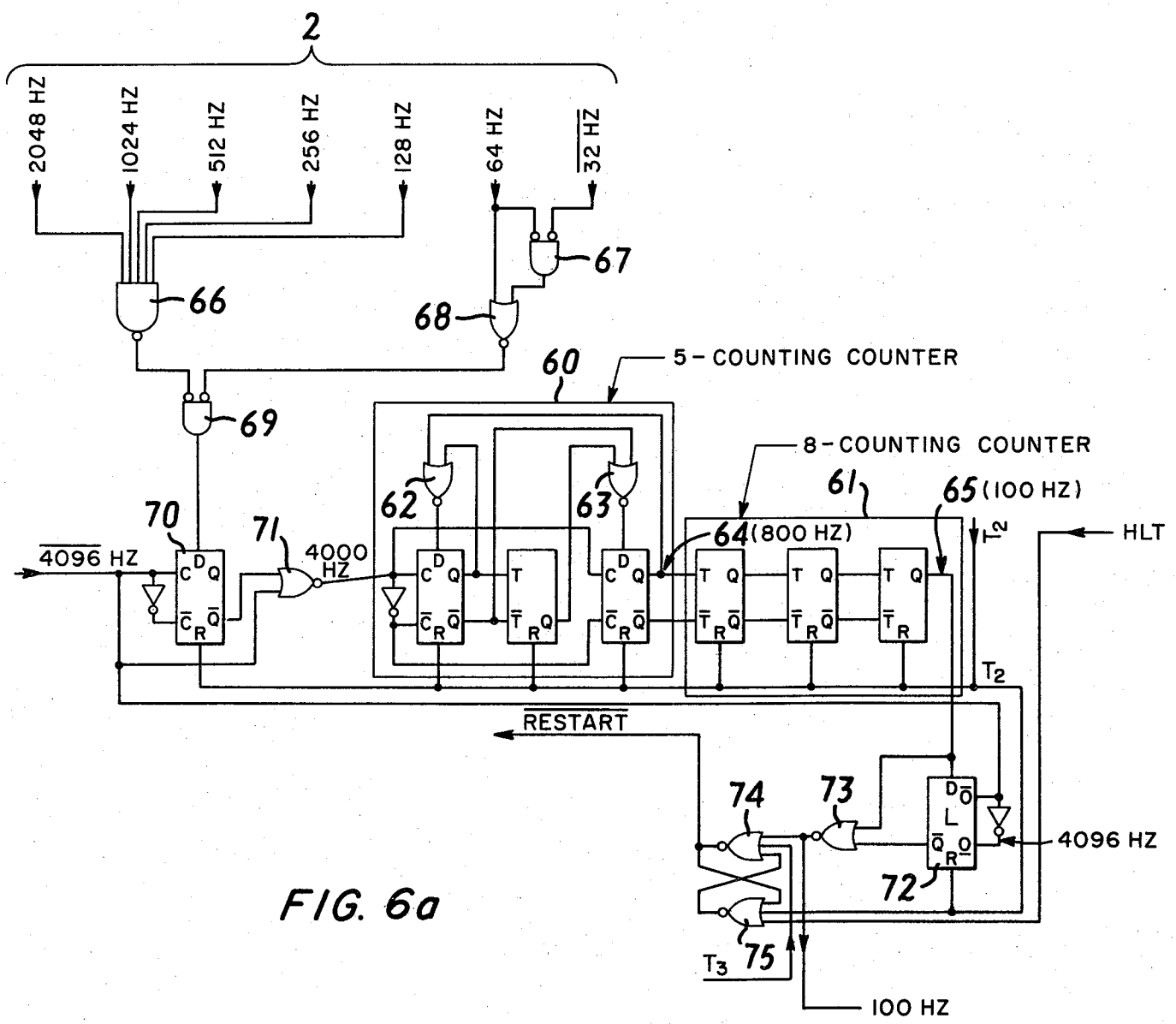
FIG. 6*a* shows a detailed circuit construction of a 100 Hz signal generator.

FIG. 6*a* shows a detailed circuit construction of the 100 HZ generating circuit. The 100 HZ generating circuit is composed of two blocks, a first block is a 400 HZ generating portion composed of NAND 66, NOR 67, 68 and 69, DFF 70 and NOR 71, and a second block composed of 5-counting counter 60 and 8-counting counter 61. 400 HZ signal of being generated in the first block is divided by the second block. Namely, it is divided to 800 HZ by a 5-counting counter and is further divided to 100 HZ by an 8-counting counter 61 whereby one is able to obtain 100 HZ signal.

The signals of 2048 HZ, 1024 HZ, 512 HZ, 256 HZ and 128 HZ are impressed to AND 66, the output of NAND 66 becomes "0" level during 1/4096 sec every 128 HZ. The four output signals of NAND 66 are generated for 1/32 sec.

The following method is employed to obtain the 4000 HZ signal from the 4096 HZ signal, namely, it is necessary to eliminate 96 pulses from 4096 HZ signal for 1 sec, therefore it is necessary to eliminate 3 pulses for 32 HZ signal (i,e, 1/32 sec).

Figure 6B:
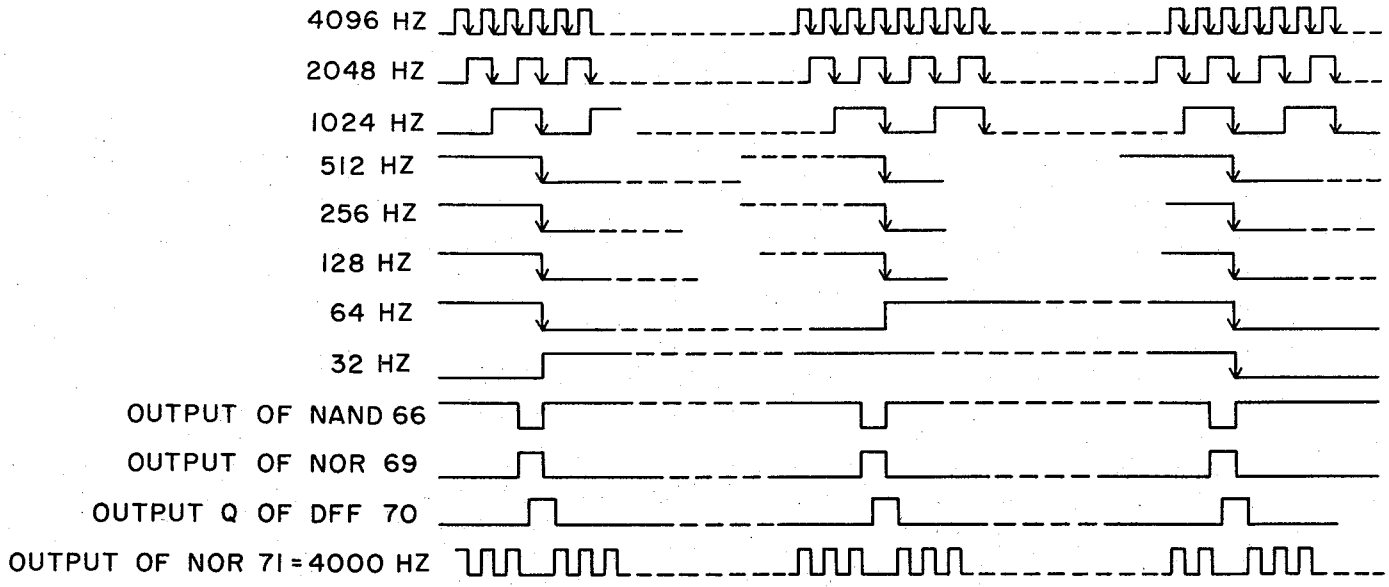
FIG. 6*b* shows a time chart of a 4000 Hz signal generator.

According to the above noted description, four output pulses of NAND 66 are generated during 32 HZ however one surplus signal is generated in this case. NOR 67, 68 and 69 as a control gate for generating three output signals of NAND 66 during 32 HZ are employed. Namely, in this circuit, first one signal thereof is inhibited, another three pulses are passed. Therefore, if one of 64 HZ or 32 HZ is "1" level, the output of NOR 68 becomes "0" level. If both of input signals of NOR 68 are "0" level, the output of NOR 68 becomes "1" level. If the output of NOR 68 is "1" level, the output of NOR 69 becomes "0" level independent of the other input level of NOR 69, at this time, and appears at the D-input terminal of DFF. Therefore, a period in which the output of NOR 68 becomes "1" is a time of which 64 HZ signal is "0" level. In this period, one output pulse of NAND 66 is existent, this one phase is inhibited. An inverted output signal of NAND 66 is impressed to D-input terminal of DFF 70 since a period except the above noted period is kept in "1" level, whereby a signal of $\overline{4096}$ HZ of which a half of period is slipped is generated. The output signal of NOR 71 in which the signals of $\overline{4096}$ HZ and output Q of DFF 70 is generated as the 4000 HZ signal which is synchronized to 4096 HZ. The above noted operation is easily understood by seeing the time-chart of FIG. 6*b*.

The 4000 HZ signal is impressed to the 5-counting counter which is composed of a pair of DFF, TFF and NOR 62 and 63 as a clock signal. The 800 HZ signal is generated to NOR 64 and is impressed to the 8-counting counter which is composed of three stages type TFF, the 100 HZ signal of duty 5090 is generated from the output terminal 65. The 100 HZ signal is impressed to the input terminal "D" of D-latch 72 and is impressed to one input terminal of NOR 73. The output $\overline{Q}$ of D-latch is impressed to the other input terminal of NOR 73, the output of NOR 73 is impressed to one input terminal of NOR 74. The 4096 HZ signal is employed as a clock input of D-latch 72. The 100 HZ signal of duty 5090 is generated to the output terminal Q of D-latch 72 in condition of a delay of a half period of 4096 HZ. The output of NOR 73 is generated as a differential pulse in a down point of 100 HZ signal of duty 5090 by a pulse width of a half of duty 5090 by a pulse width of a half period of 4096 HZ.

Figure 6C:
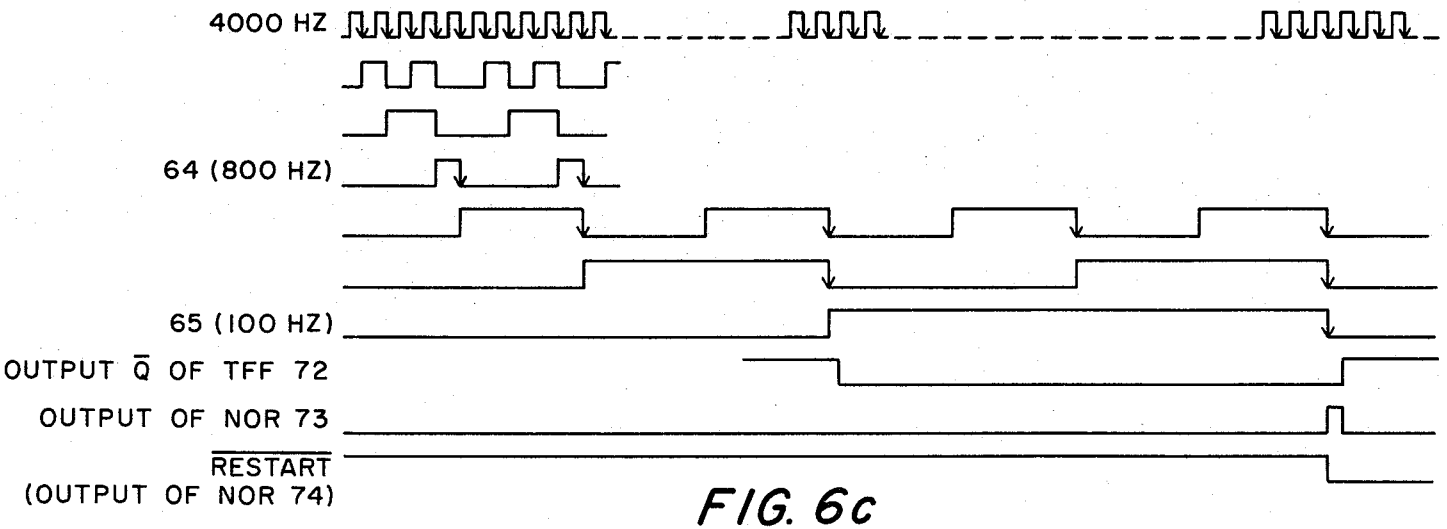
FIG. 6*c* shows a time chart of a 40-counting counter.

The output of NOR 73 is impressed to the set reset type FF which be composed of NOR 74 and 75, the set reset type FF is changed from "1" to "0", this condition is kept until HLT-INSTRUCTION has come. The signal "RESTART" becomes a very important signal for determining the operation of the system. Namely the RESTART-signal is generated whenever the 100 HZ signal is generated and is reset by the HLT-signal. The system is normally operated when RESTART-signal is while 0-level, a clock signal for a portion of dynamic operation during "1" level is stopped whereby the operation thereof is stopped. The above noted explanation will be understood by seeing FIG. 6C.

According to the present invention, at least one part of ADDRESS of ROM is driven in synchronism to the 100 HZ signal, further a program of 1/100 sec processing of a stop watch is enclosed in 0-page–9-page of ROM whereby it is able to execute the processing of 1/100 sec whenever there is a page renewal of ROM. Further it is able to execute 1/100 sec measurment by an oscillation circuit of 32 KHZ. The above noted ROM is made by MOS-IC technique whereby it is able to make the ROM-circuit in one IC chip.

We claim:

1. An electronic timepiece having multi-functions comprising in combination: a quartz oscillation circuit for generating a time standard signal; a dividing circuit for dividing an output of said quartz oscillation circuit and including means for generating a 100 Hz signal; a timing pulse generating circuit for generating timing pulse signals as input signals for operating circuit blocks; a ROM-circuit comprising a program memory for executing multi-function operations of the timepiece; an instruction PLA for generating instruction data and connected to receive the output of said ROM-circuit; a program counter and page counter for renewing the address and page of said ROM-circuit, the address and page of said program and page counters being jumped by the output of said instruction PLA; a RAM-circuit comprising a data-memory for memorizing data including a controlling memory, operated results and time information and being addressed by a plurality of decoders which are controlled directly by the output of said ROM-circuit; an operation circuit for executing operations including data comparison and data transformation; a latch circuit comprising an output data memory circuit for temporarily memorizing display data and other output data; a driver circuit for displaying at least part of the contents of said latch circuit; an alarm sound combining circuit in which a part of the output signal of said dividing circuit is applied thereto; and means for synchronously driving at least a part of the address of said program by the output of said dividing circuit.

2. An electronic timepiece having multi-functions as claimed in claim 1, wherein said means for generating the 100 Hz signal is receptive of a plurality of output signals of said dividing circuit as an input signal.

3. An electronic timepiece having multi-functions as claimed in claim 2, wherein the generating means includes means receptive of a 4096 HZ signal of said divided signal for generating a 4000 HZ signal and for dividing same by 40.

4. An electronic timepiece having multi-functions as claimed in claim 3, wherein the means for synchronously driving is receptive of said 100 HZ signal for applying the 100 HZ signal as a clock input signal of said page counter, said page counter comprising a decade counter.

* * * * *